US005282577A

United States Patent [19]

Neitz

[11] Patent Number: 5,282,577

[45] Date of Patent: Feb. 1, 1994

[54] CROSS SECTION CONTROLLED MULTI-JET INJECTION VALVE

[75] Inventor: Alfred Neitz, Wendelstein, Fed. Rep. of Germany

[73] Assignee: MAN Nutzfahrzeuge Aktiengesellschaft, Munich, Fed. Rep. of Germany

[21] Appl. No.: 707,866

[22] Filed: May 30, 1991

[30] Foreign Application Priority Data

May 30, 1990 [DE] Fed. Rep. of Germany ..... 4017391

[51] Int. Cl.[5] ..... B05B 1/32; F02M 61/08

[52] U.S. Cl. ..... 239/533.4; 239/533.7; 239/533.12; 137/625.37

[58] Field of Search ..... 239/533.3, 533.6, 533.7, 239/533.9, 533.12, 533.2, 533.8, 533.5, 533.4, 452, 459, 460, 453; 137/625.3, 625.37

[56] References Cited

U.S. PATENT DOCUMENTS

| | | | |
|---|---|---|---|
| 2,914,257 | 11/1959 | Wiant . | |
| 4,513,916 | 4/1985 | Skinner | 239/533.9 |
| 4,662,338 | 5/1987 | Itoh et al. | 239/453 |
| 4,753,213 | 6/1988 | Schlunke et al. | 239/460 |
| 4,817,873 | 4/1989 | McKay | 239/533.12 |
| 5,020,728 | 6/1991 | Linder et al. | 239/533.3 |

FOREIGN PATENT DOCUMENTS

| | | | |
|---|---|---|---|
| 830591 | 7/1952 | Fed. Rep. of Germany | 239/533.3 |
| 2710138 | 9/1978 | Fed. Rep. of Germany . | |
| 2949596 | 6/1981 | Fed. Rep. of Germany . | |

*Primary Examiner*—Andres Kashnikow
*Assistant Examiner*—Christopher G. Trainor
*Attorney, Agent, or Firm*—Robert W. Becker & Associates

[57] ABSTRACT

A cross-section controlled multi-jet injection valve for an air-distributor injection in air-compressing combustion engines is provided. In order to fulfill the more stringent requirements and standards for exhaust fume quality it is necessary to provide a homogenous fuel/air mixture. This is achieved with a valve needle which is provided with an axially and radially oriented key. Due to this key a favorable ratio of injection cross-section to circumference of the respective cross-section is achieved. Accordingly, a division of the injection jet and a mixing with air is provided. Due to correspondingly adjusted pressure springs the injection pressure at varying amounts of fuel to be injected is kept constant which furthermore provides a constant homogeneity of the fuel/air mixture. Thus an excellent exhaust fume quality is obtained for the entire performance range.

6 Claims, 4 Drawing Sheets

CROSS SECTION CONTROLLED MULTI-JET INJECTION VALVE

BACKGROUND OF THE INVENTION

The present invention relates to a cross-section controlled multi-jet injection valve comprising a valve body and a valve needle that is axially movable within the valve body, whereby the valve needle opens the valve in a direction towards the combustion chamber. The sealing seat of the valve needle corresponds to the injection cross-section of the fuel.

It has been known from DE-OS No. 29 49 596 to open the valve by moving the valve needle in the direction of the combustion chamber. The sealing seat is conically shaped and represents at the same time the outlet opening that corresponds to the fuel injection cross-section. With such an injection valve it is not possible to maintain the fuel pressure at a constant level over the entire performance range. The formation of the fuel/air mixture, and thus the fuel preparation, is impaired because the injected fuel jet in the shape of a hollow cone is not divided resulting in an unfavorable ratio of the large circumference of the annular groove to the injection cross-section.

From DE-OS No. 27 10 138 it has also been known to provide a hollow needle having a valve needle coaxially guided inside the hollow needle. The hollow needle may be supplied with fuel pressure from a pressure chamber via a pressure shoulder. Upon a predetermined fuel pressure the hollow needle opens against the force of a first pressure spring thus opening the path for the fuel to the valve needle and to a first injection bore. At a higher load of the combustion engine and a resulting higher fuel pressure generated by an injection pump the valve needle opens against the force of a second pressure spring. The injection of fuel into the combustion chamber then occurs via a second injection bore until, due to the decreasing fuel pressure, the valve needle closes and the injection is terminated. With such an injection valve a stepping of the injected amount of fuel with respect to the direction and shape of the fuel jet is achieved. However, it is disadvantageous that the fuel pressure before the injection bores may not be maintained at a constant high value over the entire performance range. A further disadvantage is the use of multiple injection ports. When under partial load only one bore is used for the fuel injection the second unused bore which only operates during full load tends to form soot.

It is therefore an object of the present invention to provide an injection valve of the aforementioned kind with which the injected amount of fuel is divided into multiple jets whereby a favorable ratio of fuel injection cross-section to the circumference of the respective cross section is provided and at the same time a constant injection pressure before the injection channels is maintained over the entire performance range.

BRIEF DESCRIPTION OF THE DRAWINGS

This object, and other objects and advantages of the present invention, will appear more clearly from the following specification in conjunction with the accompanying drawings, in which.

SUMMARY OF THE INVENTION

Figure 4:
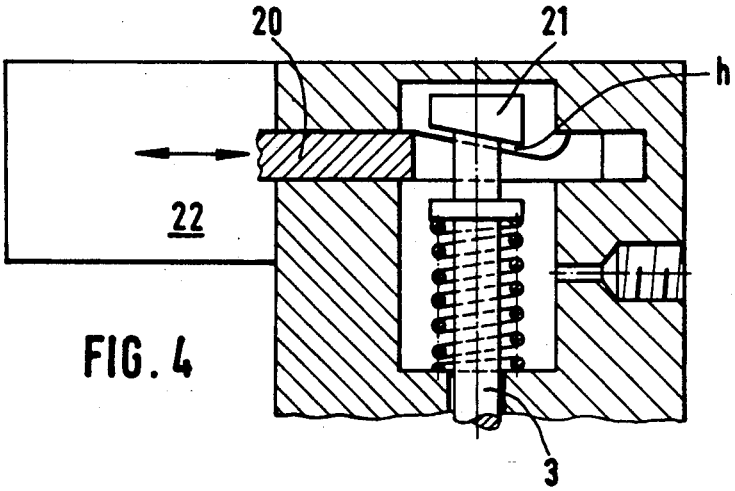
FIG. 4 shows a longitudinal cross-section of the injection valve in the area of the control means.

The injection of the present invention is primarily characterized by a sealing seat of the valve needle corresponding to an injection valve cross-section for fuel whereby the sealing seat is in the form of an axially and radially oriented key means; and a control means being disposed at an end of the valve needle whereby that end is facing away from the combustion chamber. The valve needle functions as a control needle. Preferably, the sealing seat is conically shaped.

Due to the special design of the sealing surface of the valve needle the opening cross-sections, i.e., the injection cross-section, of the valve needle may be varied so that in all operational stages of the combustion engine a sufficiently high fuel pressure is present at all times before the injection channels. Thereby it is ensured that for air distributing injections a high degree of atomization and thus an optimum mixture is provided at all times. Accordingly, the maximal injection pressure will be approximately as high in the lower engine revolution ranges and lower engine load ranges as in the upper engine revolution and load ranges.

An advantageous embodiment of the cross-section controlled injection valve is characterized in that the control means comprises at least a first and a second abutment for limiting the stroke of the valve needle; an opening movement of the valve needle is dividable into at least two stroke lengths; a first one of the stroke lengths is limited by a projection disposed at the end of the valve needle that is facing away from the combustion chamber whereby the projection abuts the first abutment that is provided in the form of an annular abutment; the annular abutment is held in a starting position by a first pressure spring that acts in parallel to a second pressure spring associated with the valve needle; and the second of the stroke lengths is limited by the annular abutment by contacting the second abutment fixed to the valve holder after respective restoring forces of the first spring and the second spring have been overcome.

In a simple manner a self-regulation of the fuel pressure with the aid of respectively adjusted springs is achieved, which, with increasing pressure, yield a greater opening cross-section and vice versa. In order to compensate for the additional pressure surface that is provided when the valve opens, a further pressure spring is provided. The first pressure spring provides an outlet cross-section for the engine when idling respectively for the lower revolution and load range, while by overcoming the further parallel acting pressure spring the opening cross-section is adjusted to the increasing engine revolutions and load. The limitation of the injection cross-section at full load and a given number of revolutions is achieved via the second fixed abutment.

A further embodiment of the present invention is characterized by the control means being in the form of a key member which is perpendicularly moved relative to the valve needle; a stroke of the valve needle is limited in an adjustable manner by an end abutment and the key member is actuatable via a control member that is controllable via an electronic device. The control of the stroke of the valve needle is achieved via a performance range-controlled electronic device.

The suitable mechanical control element for the limitation of the stroke of the valve needle may be provided in the form of a key member, which is controllable via the performance range controlled electronic device in a direct or indirect fashion thus limiting the stroke of the valve needle in a continuously adjustable manner. A stepwise adjustment is also possible.

Another advantageous embodiment of the present invention is characterized by providing a hollow needle, that is coaxially disposed at the valve needle and that acts in parallel to the valve needle, whereby the hollow needle is pressed by a third pressure spring against a conical sealing surface that is located above the sealing seat of the valve needle.

The hollow needle ensures a further sealing besides sealing in the form of the key member so that a post dripping of fuel is prevented when the key member does not seal properly.

DESCRIPTION OF PREFERRED EMBODIMENTS

The present invention will now be described in detail with the aid of several specific embodiments utilizing FIGS. 1 through 6.

Figure 1:
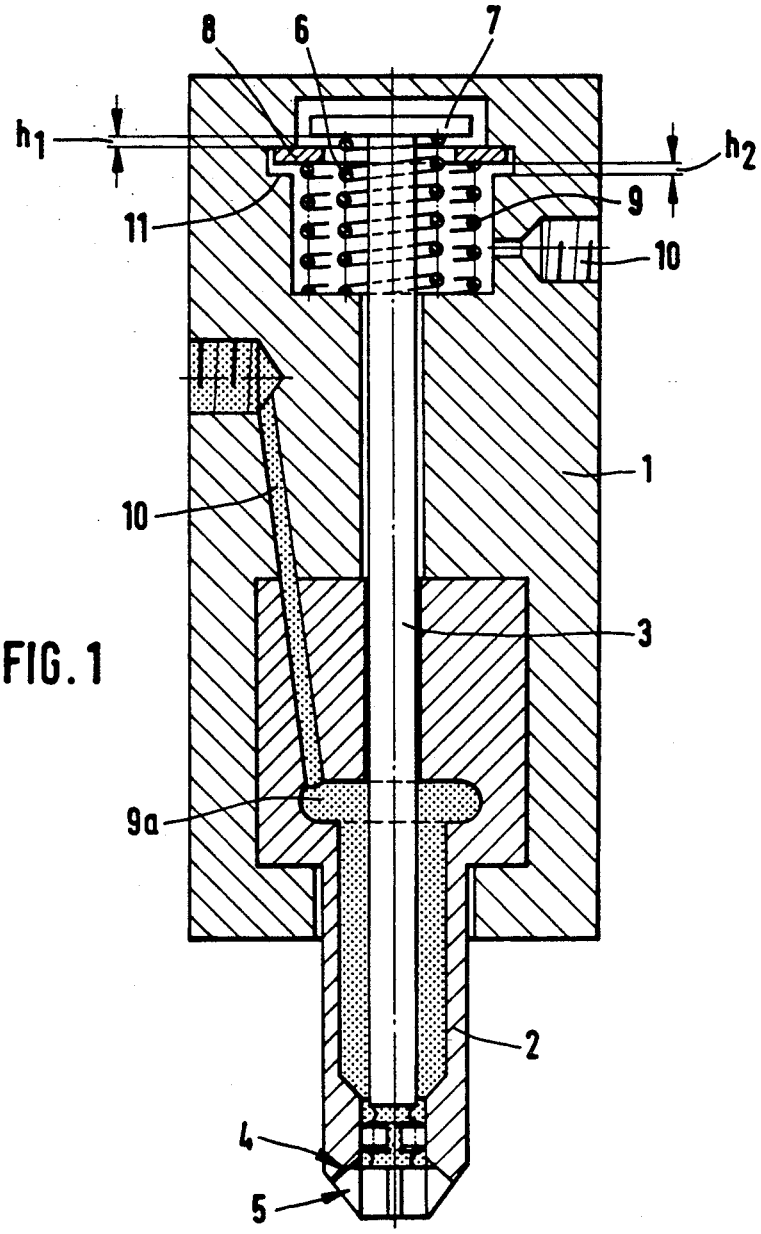
FIG. 1 is a longitudinal cross-section of an injection valve.

FIG. 1 shows in a schematic representation a longitudinal cross section of an injection valve that is primarily comprised of a valve holder 1, a valve body 2 and valve needle 3 which is disposed in an axially movable fashion within the valve body 2. The valve needle 3 is provided with a conical sealing surface 4 at its end that is facing the combustion chamber whereby the sealing is achieved with a key means 5. The valve needle 3 is held in a closing position via a prestressed pressure spring 6 that is located at its end that its facing away from the combustion chamber. The pressure spring 6 is supported, on the one hand, against the valve holder 1 and, on the other hand, against a projection 7 of the valve needle 3.

For limiting the stroke of the valve needle 3 an annular abutment 8 is provided which interacts with the projection 7. This abutment 8 is held in its position via a further prestressed pressure spring 9, whereby the annular abutment 8 is supported at the valve holder 1. Between the projection 7 and the annular abutment 8 a slot having a width h1 is provided. The pressure spring 9 is arranged coaxially relative to the valve needle 3 and its surrounding pressure spring 6.

Fuel is introduced into the pressure chamber 9*a* of the injection valve via an inlet bore 10 of the injection pump. Due to the pressure of the fuel the valve needle 3 opens in the direction of the combustion chamber because the force of the prestressed pressure spring 6 is overcome. The fuel is then injected in the form of a plurality of jets corresponding to the embodiment of the key means 5 (described in detail in FIGS. 2 and 3) into the combustion chamber. The injection cross-section may be adjusted by the stroke of the valve needle 3.

When idling or in a lower revolution or load range of the combustion engine the stroke of the valve needle 3 is limited first by the annular abutment 8 as soon as the stroke has traveled the path h1.

During increasing load, due to the slightly increasing fuel pressure, the stroke of the valve needle 3 is increased by overcoming the force of the pressure spring 9 which is parallel to the pressure spring 6 until, after passing a stroke corresponding to h2, the maximal stroke of the valve needle 3 under full load is limited by a fixed abutment 11 at which the annular abutment 8 comes to rest. The force constant of the pressure spring 9 must be chosen substantially smaller than the force constant of the pressure spring 6. The fixed abutment 11 is provided in the form of an annular face at the valve holder 1. For removing leaking fuel a bore 10*a* is provided.

Figure 2:
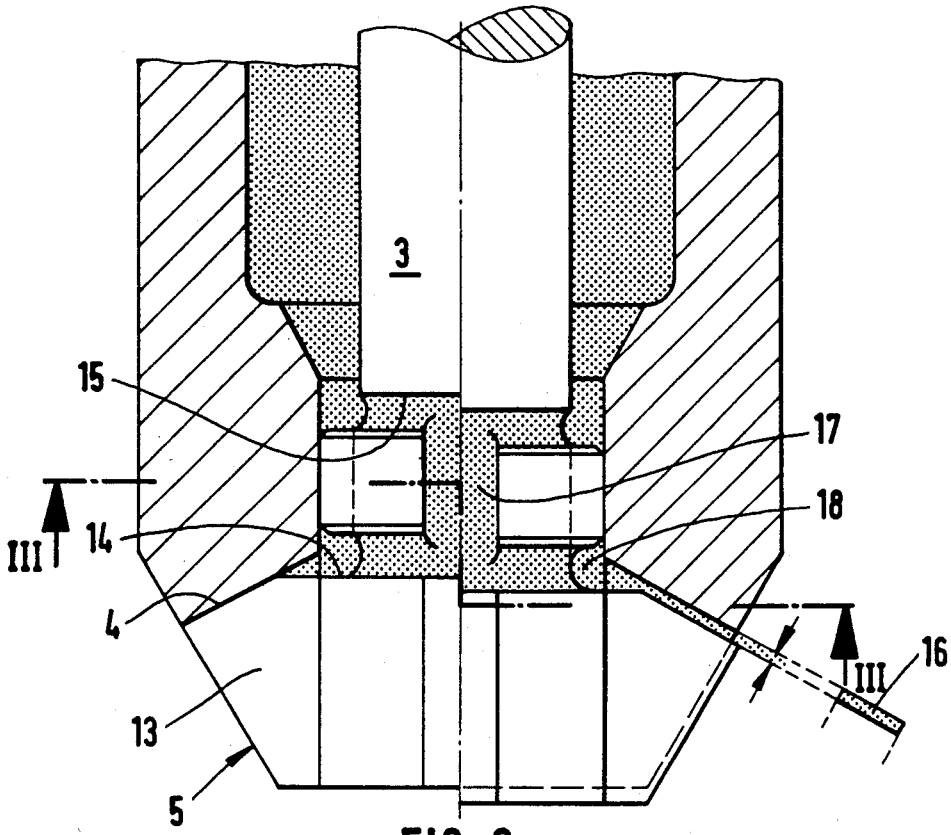
FIG. 2 is a detailed view of a longitudinal cross-section of that end of the injection valve that is facing the combustion chamber.

A detail of the injection valve in a cross sectional view at the end facing the combustion chamber is represented in FIG. 2. The left half presents the injection valve in its closed position while the right half shows the valve in its open position.

The valve needle 3 is provided with a key means 5 that is axially and radially oriented. The key means 5 is essentially comprised of a conically shaped sealing surface 4 and key faces 13.

The fuel injection is induced (as shown in the right half of the drawing) when the valve needle 3 opens in the direction of the combustion chamber due to the effect of the fuel pressure onto the surface that remains as a difference between the greater first surface 14 and the smaller second surface 15. The fuel is introduced into the key means 5 via a groove 17 and an annular space 18. One of the injection cross-sections 16 that are formed when the valve needle 3 opens is represented in detail.

Figure 3:
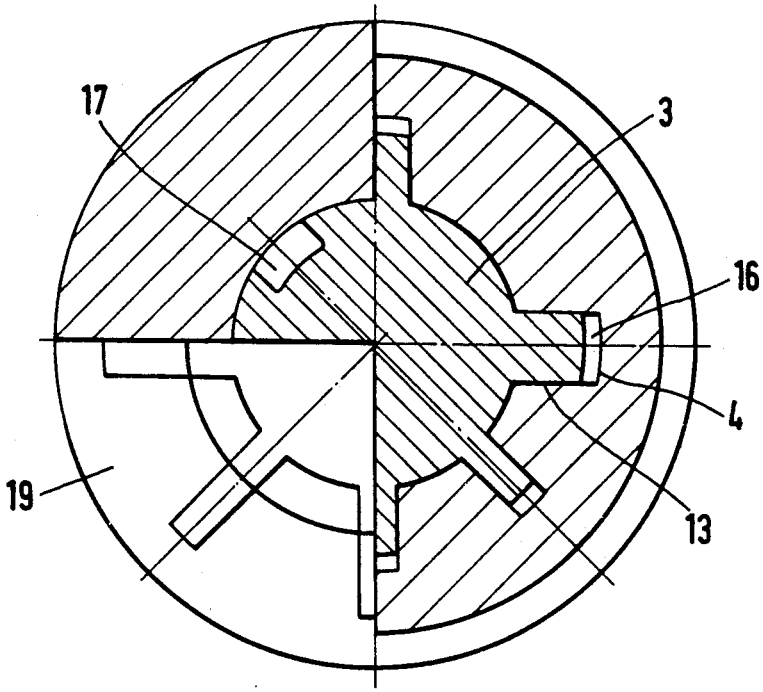
FIG. 3 represents a view along the line III—III of FIG. 2.

A view along the line III—III of FIG. 2 is represented in FIG. 3. The fuel first enters via the groove 17 of the valve needle 3 into the area before the sealing surface 4 (as can be seen in FIG. 2) which is provided in a conical shape in this embodiment. After the opening of the valve needle 3 the fuel is injected via the injection cross-sections 16. The respective injection cross-sections 16 are limited by the conical sealing surface 4 (FIG. 2) and the key faces 13. They can be provided in different sizes. A sector 19 is represented in a plan view in FIG. 3, i.e., not in cross section.

An alternative to the control of the valve needle 3 according to FIG. 1 is represented in FIG. 4. The stroke of the valve needle 3 is limited by a key member 20 which is associated with an end abutment 21 by a movement corresponding to the direction of the arrow. Thereby the stroke movement of the valve needle 3 is limited in a continuous manner corresponding to the play h. The key member 20 is actuated via a control element 22 which in return is actuatable via a performance range-controlled electronic device.

Figure 5:
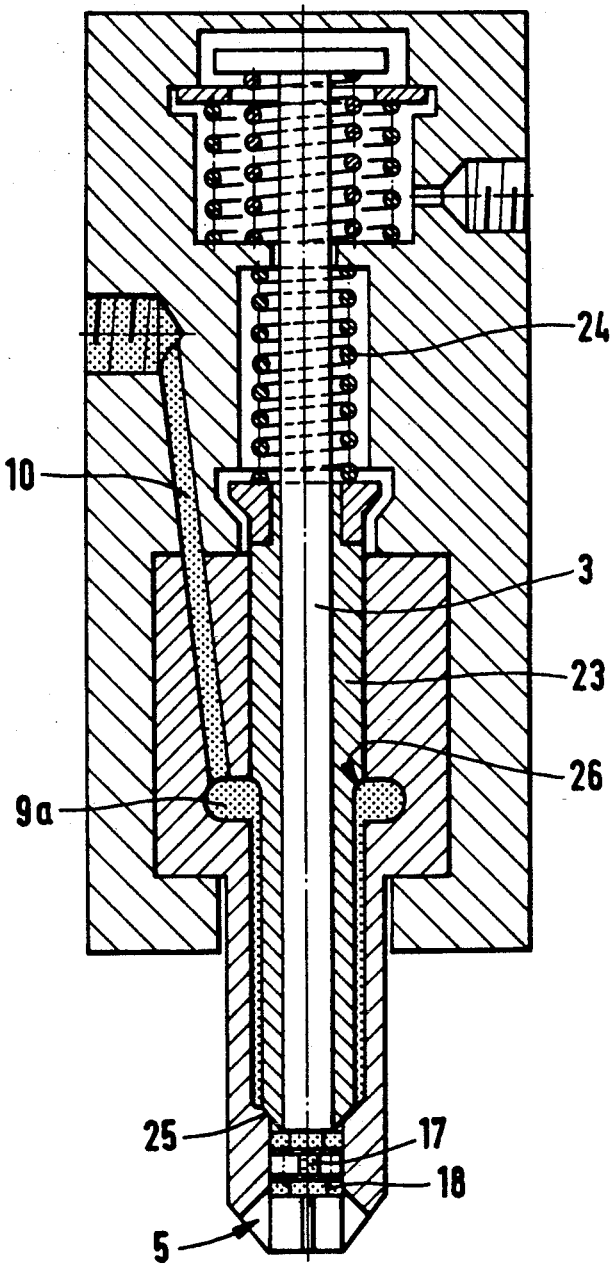
FIG. 5 shows a longitudinal cross-section of an injection valve having a hollow needle coaxially arranged relative to the valve needle.

A variation of the injection valve as represented in FIG. 1 is shown in FIG. 5. In this embodiment the valve needle 3 is actuatable in parallel to a coaxially movable hollow needle 23. The hollow needle 23 is held in a starting position by a prestressed pressure spring 24 and additionally seals the key means 5 via a conical surface 25 against the pressure chamber 9*a*. When fuel coming from the injection pump via the inlet bore 10 is pressurized inside the pressure chamber 9*a* the hollow needle 23 first opens against the force of the pressure spring 24. The effective pressure surface is defined by the difference of the surfaces of a pressure shoulder 26 and the conical surface 25 which is not exposed to the fluid pressure in the closing position. After the hollow needle 23 has been opened the fuel enters the annular space 18 via the grooves 17 and opens subsequently (as described in FIG. 1) the valve needle 3. The advantage of such an embodiment is that the key means 5 must not solely provide the sealing function.

Figure 6:
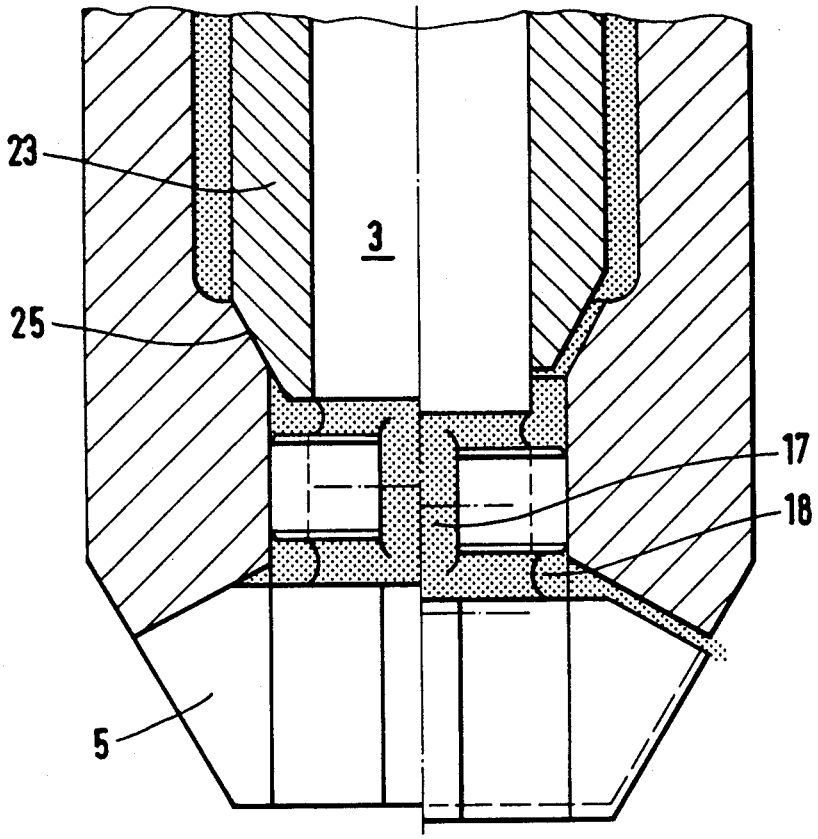
FIG. 6 shows a detailed view of FIG. 5 in a longitudinal cross section of that end of the valve needle that is facing the combustion chamber.

FIG. 6 shows in detail the end of the injection valve that is facing the combustion chamber in the version of FIG. 5. The valve needle 3 is surrounded by the hollow needle 23 which, via the conical surface 25, seals additionally the key means 5 against the pressure chamber 9*a* (FIG. 5). This is shown in the left half of FIG. 6. When increasing the fuel pressure the hollow needle 23 is lifted off the conical surface 25 as represented in the right half of FIG. 6. The pressurized fuel then enters, via the grooves 17, the annular space 18 before the key means 5. Against the force of the pressure springs 6 and 9 the valve needle 3 opens, as described in FIG. 1.

In the following paragraph the function of the injection valve will be briefly summarized. At the beginning of the injection step the hollow needle 23 (corresponding to FIGS. 5 and 6) respectively the valve needle 3 (corresponding to FIGS. 1 and 2) opens and yields the required injection cross-section 16. The control of the injection cross-section may be achieved with the aid of the fuel pressure and respective effective pressure surfaces in a known manner in conjunction with pressure springs 6, 9, 24, or with the aid of a performance-range dependent, preferably electronic, controllable stroke limiting device (FIG. 4). Injection fuel pressure and injection duration may thus be adjusted in an optimum fashion.

At the end of the injection process, after the closure of the hollow needle 23, the injection channels are closed due to the repositioning of the valve needle 3. At this stage the fuel which is still present in the injection channels is removed under pressure so that droplet formation at the end of the injection process is avoided. Furthermore, the fuel volume that is already present at the hollow needle may not flow into the combustion chamber in an uncontrollable manner. The continuous axial movement of the valve needle 3 having different lengths of stroke, due to the operational conditions of the engine, ensures that, despite the tendency of soot formation at the key means which are facing the firing, the inventive injection cross-section control remains operable.

The present invention is, of course, in no way restricted to the specific disclosure of the specification and drawings, but also encompasses any modifications within the scope of the appended claims.

What I claim is:

1. A cross-section controlled multi-jet injection valve for an air-distributor injection in air-compressing combustion engines, comprising:

a valve body having an axially and radially oriented first key means;

a valve needle that is axially movable within said valve body, wherein said valve needle opens said valve in a direction toward a combustion chamber, said valve needle having a sealing seat that corresponds to an injection cross-section for fuel, wherein said sealing seat is conically shaped and in the form of an axially and radially oriented key means that meshes with said key means of said valve body when the valve is closed; and a control means for controlling the stroke of said valve needle being disposed at an end of said valve facing away from said combustion chamber.

2. A cross-section controlled multi-jet injection valve according to claim 1, wherein:

said control means comprises at least a first and a second abutment for limiting the stroke of said valve needle;

the stroke of said valve needle is dividable into at least two stroke lengths;

a first one of said stroke lengths is limited by a projection disposed at said end of said valve needle that is facing away from said combustion chamber, with said projection abutting said first abutment, said first abutment being in the form of an annular abutment;

said annular abutment is held in a starting position by a first pressure spring that acts in parallel to a second pressure spring associated with said valve needle; and a second one of said stroke lengths is limited by said annular abutment contacting said second abutment after respective restoring forces of said first spring and said second spring have been overcome, said second abutment being formed on said valve body.

3. A cross-section controlled multi-jet injection valve according to claim 1, wherein:

said control means is in the form of a key member which is perpendicularly movable relative to said valve needle, said valve needle having an end abutment on its end opposite said sealing seat;

the stroke of said valve needle is limited in an adjustable manner by contact between said end abutment and said key member; and said key member is movable via a control member that is controllable via a performance range-controlled electronic device.

4. A cross-section controlled multi-jet injection valve according to claim 3, wherein said valve needle is adjustable in a continuous manner.

5. A cross-section controlled multi-jet injection valve according to claim 3, wherein said valve needle is adjustable in a stepwise manner.

6. A cross-section controlled multi-jet injection valve according to claim 1, further comprising a hollow needle, that is coaxially disposed about said valve needle, whereby said hollow needle is pressed by a third pressure spring against a conical sealing surface located above said sealing seat of said valve needle.

* * * * *